US007452308B2

(12) United States Patent
Robideau

(10) Patent No.: US 7,452,308 B2
(45) Date of Patent: Nov. 18, 2008

(54) CROSS-CRAWL CHAIR

(76) Inventor: Robert G. Robideau, 555 Sun Valley Dr., Suite D-4, Roswell, GA (US) 30076

( * ) Notice: Subject to any disclaimer, the term of this patent is extended or adjusted under 35 U.S.C. 154(b) by 0 days.

(21) Appl. No.: 11/514,170

(22) Filed: Sep. 1, 2006

(65) Prior Publication Data

US 2007/0072741 A1 Mar. 29, 2007

Related U.S. Application Data

(60) Provisional application No. 60/714,891, filed on Sep. 8, 2005.

(51) Int. Cl.
*A63B 21/00* (2006.01)

(52) U.S. Cl. ..... 482/51; 482/56; 482/52

(58) Field of Classification Search ..... 601/23, 601/24, 26, 33; 482/51, 52, 56, 57
See application file for complete search history.

(56) References Cited

U.S. PATENT DOCUMENTS 2,109,775 A * 3/1938 Hudson ..... 482/56
3,791,646 A * 2/1974 Marchignoni ..... 482/56
4,402,502 A 9/1983 Peters
4,684,126 A 8/1987 Dalebout et al.
5,207,216 A * 5/1993 Sweeny ..... 601/5
5,407,406 A * 4/1995 Canela ..... 482/51
5,611,758 A 3/1997 Rodgers, Jr.
5,709,633 A 1/1998 Sokol
5,964,682 A 10/1999 Sokol
6,752,744 B2 6/2004 Arnold et al.
6,790,162 B1 9/2004 Ellis et al.
6,821,234 B1 * 11/2004 Barbee ..... 482/57
6,835,166 B1 12/2004 Stearns et al.

* cited by examiner

*Primary Examiner*—Glenn Richman
(74) *Attorney, Agent, or Firm*—Dowell & Dowell, P.C.

(57) ABSTRACT

A cross-crawl chair including a chair frame for supporting a headrest, chair back, chair seat, right and left arm supports, right and left leg supports, and four actuators for moving the supports. The chair also includes a control system which synchronizes the movement of the right arm actuator with the left leg actuator and the movement of the left arm actuator with the right leg actuator so as to provide an "arm and opposing leg" or cross-crawl motion. Further, the electro-mechanical control system controls a speed, a length of time, and a range of the cross-crawl motion.

15 Claims, 6 Drawing Sheets

CROSS-CRAWL CHAIR

CROSS-REFERENCE TO RELATED APPLICATION(S)

This application claims priority to U.S. Provisional Patent Application Ser. No. 60/714,891, filed Sep. 8, 2005, entitled, "CrossCrawl Chair."

BACKGROUND OF THE INVENTION

1. Field of the Invention

The present invention generally relates to a chair which is mechanically-hydraulically actuated and electronically operated so that it does not require a user's physical efforts to produce motion. More specifically, the present invention is directed to such a chair that is capable of moving in an "arm and opposing leg" or cross-crawl motion.

2. Brief Description of the Related Art

For a person afflicted with partial or complete paralysis, neurological injuries, atrophy, physical impairments, or other types of injury or illness that cause the person to loose partial or full use of his or her limbs, retraining the person's brain patterning via means of "arm and opposing leg" exercise motion is a superior method to help the person gain greater range of motion in his or her limbs, neck and head, and extremities. In more serious cases, the "arm and opposing leg" motion can allow the person to regain the ability to voluntarily move and use his or her limbs, neck and head, and extremities. Specifically, the use of an "arm and opposing leg" neurological retraining device will re-pattern a person's brain and spinal cord to generate and organize the correct signals to allow the voluntary control of limb, neck and head or extremities.

Most existing equipment exercises involve one or both arms, one or both legs, or a combination of either right arm/right leg or left arm/left leg. This is called homolateral patterning. However, homolateral patterning does minimal exercising of neck and head, and even less exercising of the extremities, especially after an injury or illness.

Further, most exercise or retraining machines on the market today depend on human power (a person's own physical efforts) to perform exterior limb or other body movements. This means that the treatment therapy is exclusively beneficial to people who have voluntary control over their limbs. In other words, these therapies exclude and are not beneficial to the many people who partially or completely lack the ability to voluntarily control their limbs. Many people with partial or full loss of limb function, of neck and head function, or of spinal cord function, do not have sufficient limb or spinal strength or flexibility, to provide enough human power to properly utilize the existing equipment's capability. Furthermore, these individuals may not have the endurance in their overall bodies, limbs, head and neck, or extremities to effectively utilize the existing equipment properly. As such, results from existing exercise equipment where a person has to supply the power will be quite limited in their effectiveness.

In the prior art, there are several exercise devices which do not rely on the patient or user to supply the physical effort needed to power the equipment. U.S. Pat. No. 6,685,658, issued to Dietz et al., relates to an apparatus which moves the legs of a disabled person in a movement pattern that is similar to physiological walking. The device, which is a table, can be rotated from the horizontal position to the vertical.

A similar concept is used in U.S. Pat. No. 5,783,869, issued to Berdut. This apparatus is a horizontal table which can be tilted up from a flat horizontal plane. The drive mechanism provides reciprocal movement of a bed back and forth along the chassis in order to flex the joints and muscles in the limbs.

In the case of U.S. Pat. No. 5,901,581, issued to Chen et al., a rehabilitation apparatus consists of a transversely movable slider mechanism which is used to power the device to provide motion to the legs of the patient or user. The patient or user is in a horizontal, lying position when the motion treatment is being given.

In all three of these prior art devices, the patient or user is basically on a horizontal platform similar to a bed, at least to start the treatment exercise. None of these devices utilizes a chair platform to provide the exercise motion. Further, none of these patents discusses exercising the arms, as well as the legs. Moreover, there is no "arm and opposing leg" or gaiting exercise disclosed.

The idea of "arm and opposing leg" or at least a limited partial gaiting exercise appears in U.S. Pat. No. 4,628,909, issued to Tietsworth. Here, the device is powered so that a user does not have to operate the apparatus by supplying their own power, but only along one axis. There is no independent control of the arms and legs. However, the patient or user is in the supine position on a platform like a bed. Therefore the treatment is significantly less effective than it is with the "arm and opposite leg" treatment for a patient or user who is sitting in a chair undergoing "arm and opposite leg" treatment.

In two patents issued to Sokol, U.S. Pat. No. 5,964,692, which is a continuation of U.S. Pat. No. 5,709,633, a reciprocating exercise machine works on a "cross-crawl" principle, but it has two shortcomings. First, a user's head, back, and spine are in a position which is close to horizontal, rather than vertical, as it is in a chair. Second, the user has to supply all of the power to operate the machine.

In U.S. Pat. No. 5,611,758, issued to Rodgers, and U.S. Pat. No. 4,684,126, issued to Dalebout et al., an exercise apparatus positions the user's upper body in a semi-vertical position but with the legs in a semi-horizontal position. Again, this is not as neurologically effective as sitting in a chair. In addition, the user has to supply their own power to the device.

In U.S. Pat. No. 4,834,073, issued to Bledsoe et al., and U.S. Pat. No. 4,930,497, issued to Saringer, the disclosed exercise device is a passive one. That is, movement of the exercise device is dependent on the patient or user providing the physical effort to run the equipment. Further, both of these patents address leg exercises without addressing any exercises for the arms.

In U.S. Pat. No. 6,893,386, issued to Charoenchit, a device initially serves as a horizontal platform, like a bed. It can then be further adjusted into a chair form. Once again, the apparatus is a passive one, i.e. dependent on the patient's or user's physical efforts to power the equipment.

In U.S. Pat. No. 5,820,519, issued to Slenker, exercise equipment is used by attaching an apparatus to a headboard of a bed. Although the device provides exercises to both arms and both legs, once again, the patient or user has to provide all of the physical effort to power the equipment.

In U.S. Pat. No. 5,820,532 issued to Oliver, exercise equipment is also attached to a bed-like structure. Even though it is designed to exercise both arms and legs, once again, the use of the equipment is passive in nature, i.e. it depends on the patient or user to provide all of the physical effort and strength to power the equipment.

If the treatment therapy relies on a person's physical efforts to power the equipment, i.e. if the device needs to be human powered, then the treatment therapy will not have proper regulation of either the speed or the duration of the exercise treatment, nor will it provide the range of motion from the exercise treatment. Thus, it will be mostly ineffective. Further, due to the differences in human physiology, as well as the differences in a person's ability to engage in intensive and/or prolonged sessions with the machines to which he or she has to provide his or her own human effort, a person's progress is very difficult to measure. At any rate, any progress will be slow and quite uneven. Moreover, subject to the person's pain tolerance level, there might not be any measurable progress at all.

Further, unless the treatment therapy utilizes the "arm and opposing leg" approach, versus a single limb, both arms or both legs, same arm and same leg approach, neck and head treatment, or extremities treatment without incorporating the "arm and opposing leg" approach, the human brain will not receive adequate re-patterning signals to regain optimal use of the affected limb or limbs, neck and head, or extremities. Thus, there exists a need for an exercise or treatment apparatus that provides "arm and opposing leg" motion without requiring human power to operate the apparatus.

SUMMARY OF THE INVENTION

In accordance with the present invention, there is provided a cross-crawl chair which is mechanically and hydraulically driven and has electrical controls to operate the chair in a "arm and opposing leg" manner in order to help a user to re-pattern his or her gait so that the user can regain the use of one or more limbs, neck and head, or extremities. With the cross-crawl chair, treatment is available to patients who are not served by traditional human powered therapy equipment, and patients' progress will be steady, measurable, controllable, and sustainable.

It is therefore an object of the invention to provide a therapeutic device which helps reconnect a person's neurological control brain patterns to allow the person to regain voluntary and reflexogenic use of paralyzed or injured limbs, neck or head, or extremities.

It is a further object of the present invention to provide a therapeutic chair having a range of motion that will be entirely focused on providing a user considerable "cross-crawl" brain re-patterning by the "arm and opposing leg" retraining and strengthening of both the central nervous system and the neuro-muscular skeletal system through moving the arms and legs in opposite directions (180 degrees out of phase) like that of a normal walking or gait motion.

It is another object of the present invention to provide an "arm and opposing leg" exercise therapy, as opposed to single limb, one arm/one leg on the same side of the body, or separate exercise for parts of the body without doing anything to re-pattern the arm and leg gait so that when combined with mechanical and hydraulic activation, re-patterning of the arm and leg gait is likely to take place.

It is another object of the invention to provide a "arm and opposing leg" or "cross-crawl" effect to a user without the user having to use his or her own power to drive the chair's movement, thus providing far superior neurological therapeutic effects.

It is another object of the invention to provide a slow, steady cross-crawl effect to a user in a therapeutic device which can be varied in speed from slow to fast, in duration from short to long, in intensity from low to high, and in usage from occasionally to several times daily, which will allow the user to make measurable progress in regaining partial or full use of injured or non-moving limbs, neck and head, or extremities.

It is a further object to provide an exercise device having some resemblance to a conventional chair that has some moving parts, but the exercise device will operate very differently in that each of the arms and legs can move and be controlled independently, can move only one limb at a time, can move in pairs, i.e one arm with opposite leg, and can move "arm and opposing leg", i.e. left arm with right leg and right arm with left leg. As a result, the therapeutic chair be used both as a conventional exercise machine and in the "cross-crawl" or "arm and opposing leg" mode. Further, each of the axes (right arm, right leg, left arm, left leg) can be controlled independently, thus permitting the chair to be used with standard homolateteral exercise, as well as cross-crawl. This allows persons who have lost one, two or three limbs to use the chair.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
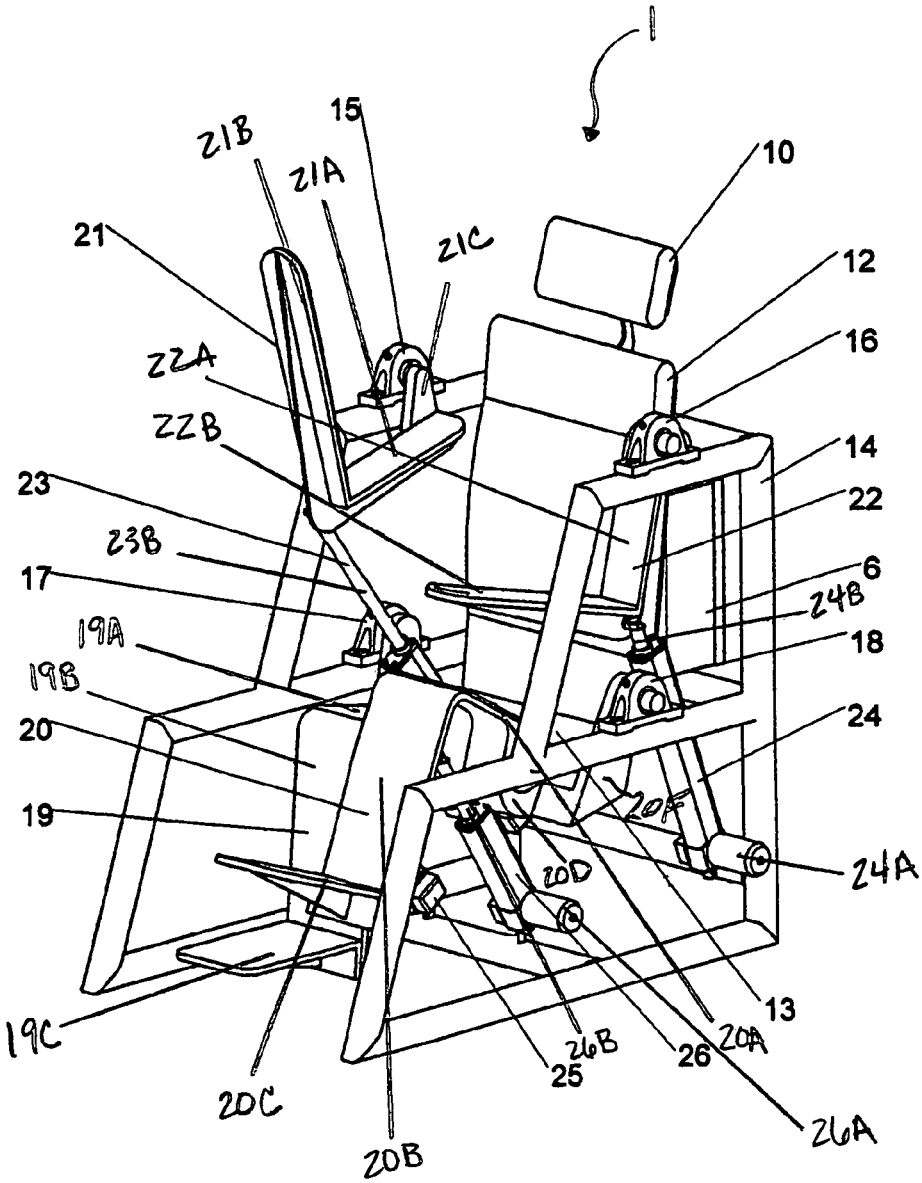
FIG. 1 is a front perspective view of a cross-crawl chair of this invention.

With continued reference to the Figures, a cross-crawl chair 1 includes a headrest 10 that is flexibly and movably attached to a top of a chair back 12 so that the cross-crawl chair 1 can be comfortably used by people of various sizes. The headrest 10 may be unpadded or padded with any appropriate fabric and/or padding.

The chair back 12 is attached to a top cross member of a chair frame 14. Like the headrest 10, the chair back 12 may be unpadded or padded with any appropriate fabric and/or padding. Further, a top of the chair back 12 may have padding so that the top of the chair back 12 can serve as a neck rest. A chair seat 13 is attached to a bottom part of the chair back 12 and to the chair frame 14. The chair seat 13 may also be unpadded or padded with any appropriate padding and/or fabric.

An electrical enclosure 6 is rigidly installed on a back of the chair frame 14 between a top rear bar and a middle rear bar. The electrical enclosure 6 houses electrical components and controls that provide speed, motion, and control to the cross-crawl chair 1.

A right arm pivot point mounting bearing 15 is rigidly attached to a top right member of the chair frame 14, and a left arm pivot point mounting bearing 16 is rigidly attached to a top left member of the chair frame 14. A right leg pivot point mounting bearing 17 is rigidly attached to a middle right member of the chair frame 14, and a left leg pivot point mounting bearing 18 is rigidly attached to a middle left member of the chair frame 14.

The chair includes a right leg support 19 and a left leg support 20. Each leg support 19,20 includes an upper leg or thigh support platform 19A,20A that extends transversely to, and preferably at approximately 90°, with respect to a depending lower leg or calf support platform 19B,20B. Foot rests or supports 19C,20C extend outwardly and forward from lower ends of the calf support platforms 19B,20B. The right leg support 19 supports a person's right leg, and the left leg support 20 supports a person's left leg when the person is seated in the chair 1.

Figure 2:
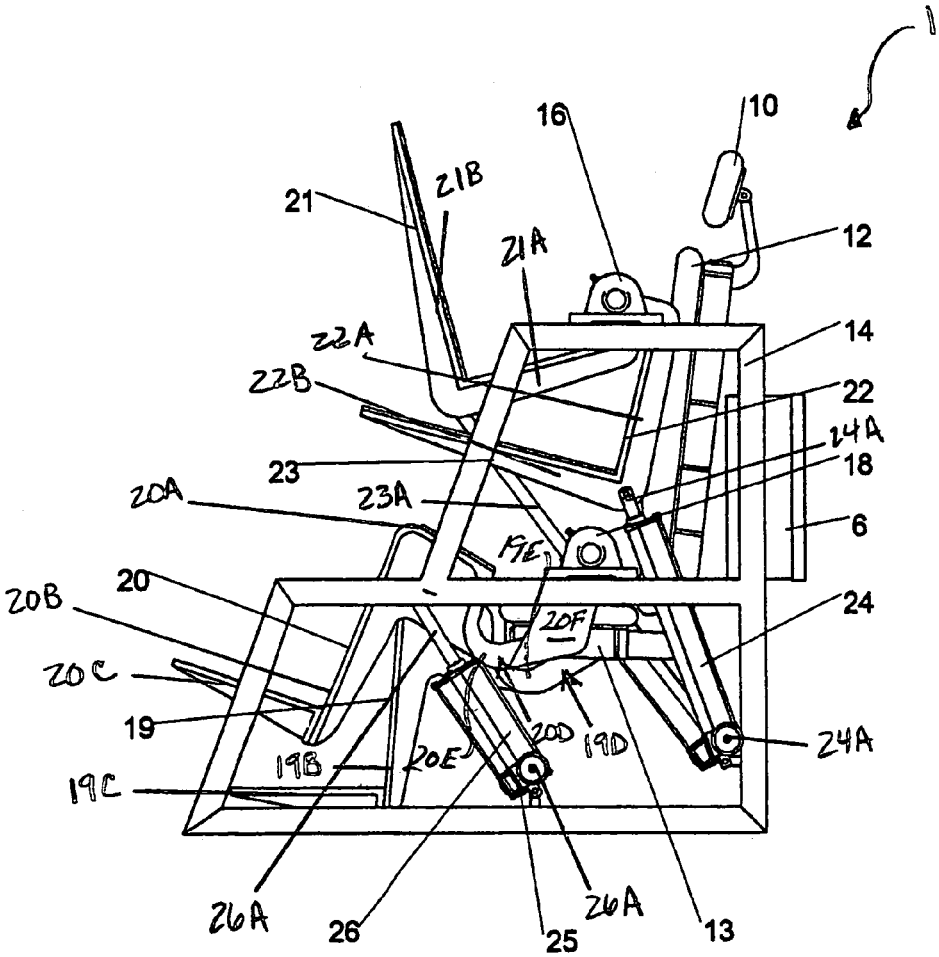
FIG. 2 is a side view of the cross-crawl chair.
Figure 3:
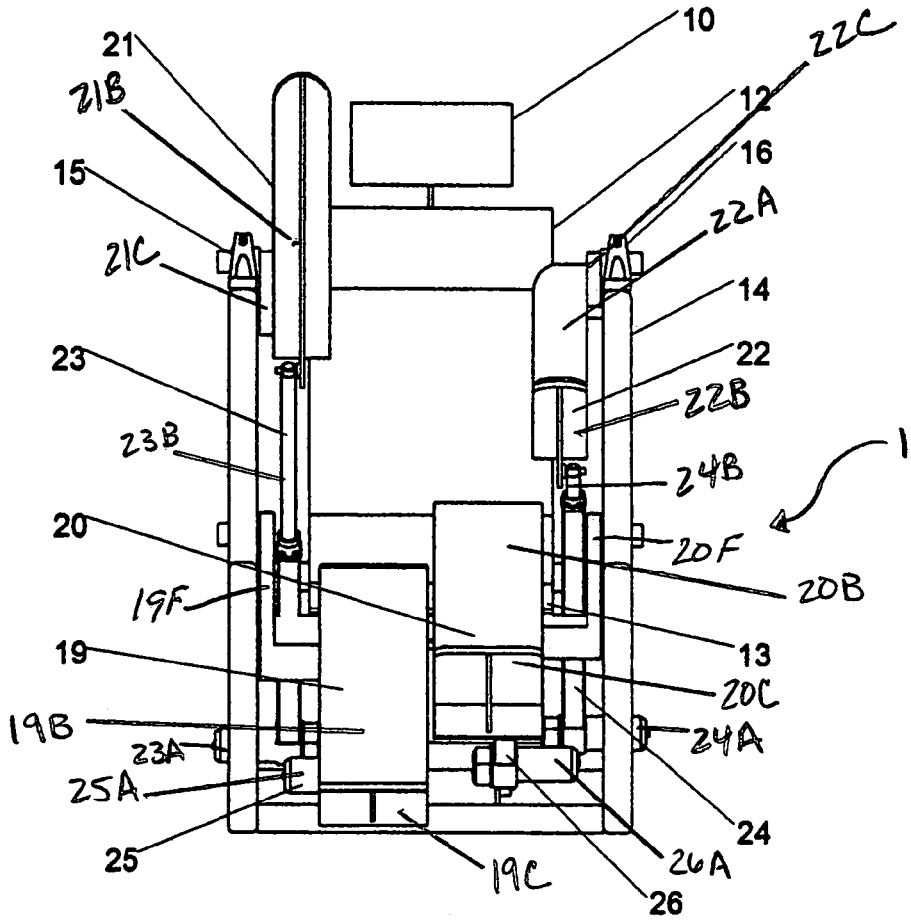
FIG. 3 is a front elevation view of the cross-crawl chair.
Figure 4:
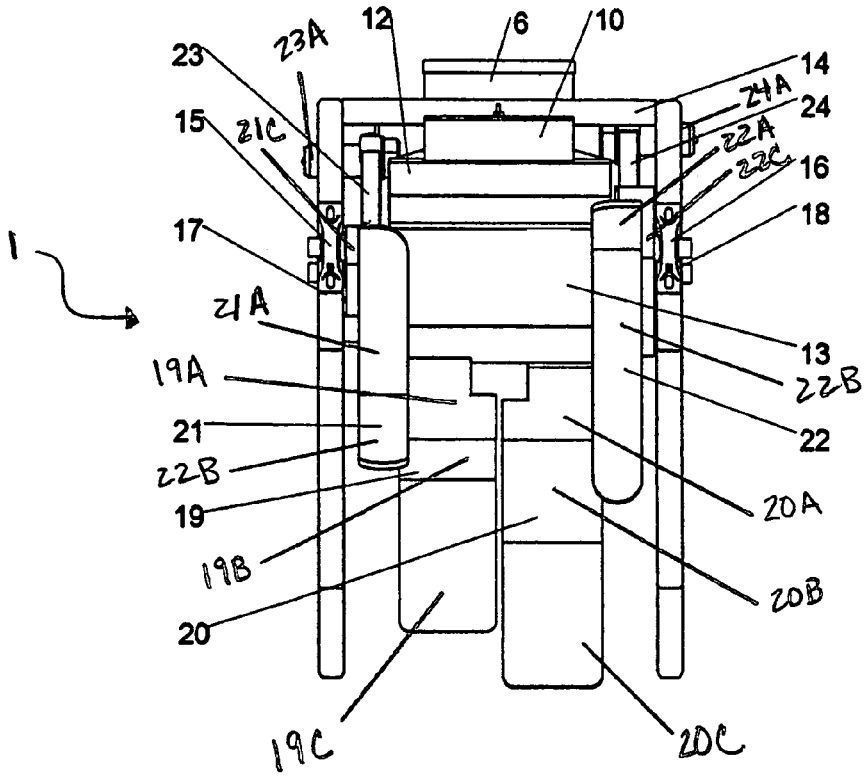
FIG. 4 is a top view of the cross-crawl chair.
Figure 5:
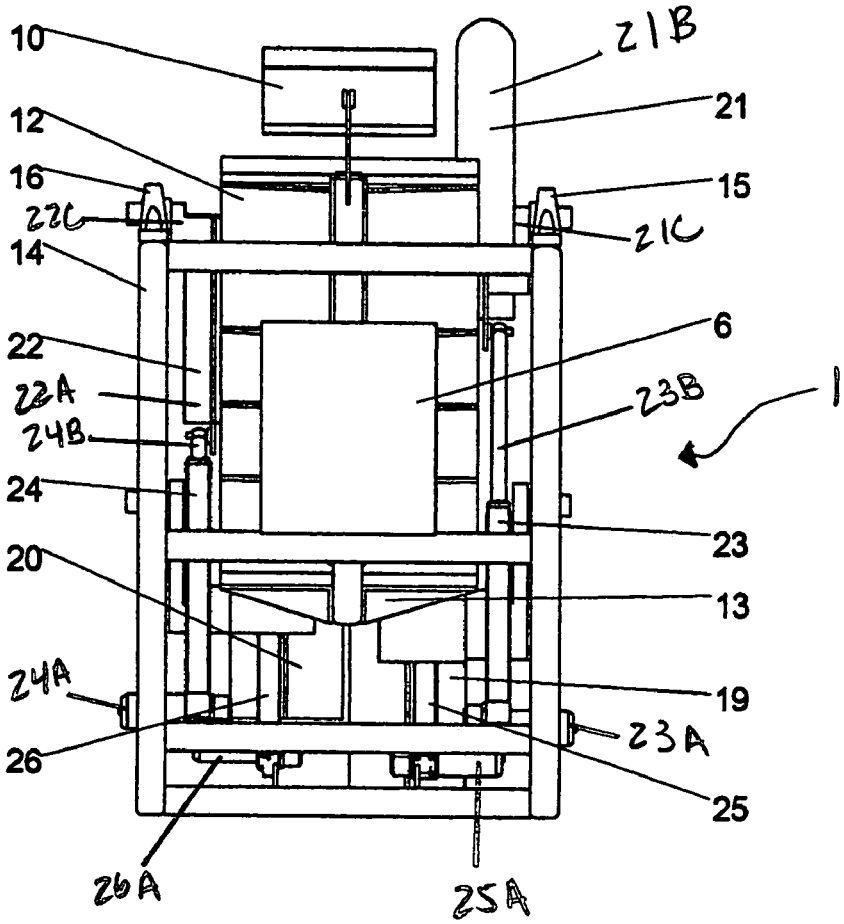
FIG. 5 is a rear elevation view of the cross-crawl chair.
Figure 6:
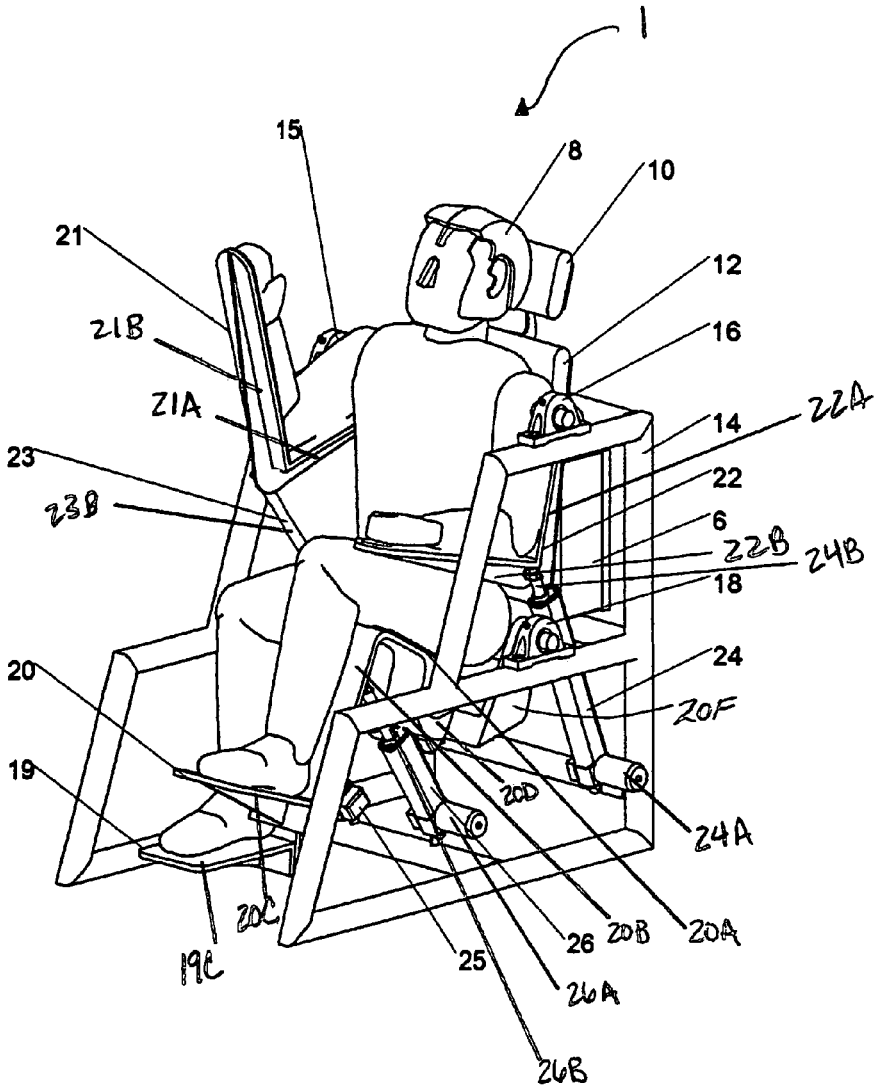
FIG. 6 is a front perspective view of the cross-crawl chair with a model of a person shown sitting in the chair.

The leg supports are attached to the chair so as to be movable independently of the chair seat. The leg supports 19,20 are attached to the chair frame 14 by way of connector portions 19D,20D, which extend from an inner end of the thigh support platforms 19A,20A, outwardly on opposite sides of the seat, to pivot pins mounted within the bearings assemblies 17 and 18, respectively. As shown and FIGS. 1 and 2, the connector portions each have a generally U-shaped portion 19E,20E that extend from the inner end of each of the thigh support platforms 19A, 20A. At the other end of the U-shaped portion, each connector portion includes a generally reverse L-shaped portion having a lower portion that extends laterally and outwardly from the U-shaped portion, as best seen in FIG. 1, and an upper portion 19F,20F that extends upwardly to the bearing assemblies 17 and 18, respectively. In this manner, the right leg pivot point mounting bearing 17 provides a pivot point for the right leg support 19, and the left leg pivot point bearing 18 provides a pivot point for the left leg support 20.

A lower surface or bottom of the right leg support 19 is pivotally connected to a right leg actuator 25, such as an electric motor, hydraulic cylinder(s), pneumatic cylinder(s) or the like, that drives a reciprocating driving mechanism 25A, such as a rack and pinion mechanism for reciprocally moving a member or rod 25B. Likewise, a lower surface or bottom of the left leg support 20 is pivotally connected to a left leg actuator 26, such as an electric motor, hydraulic cylinder(s), pneumatic cylinder(s), or the like, that drives a reciprocating driving mechanism 26A, such as a rack and pinion mechanism for reciprocally moving a member or rod 26B.

The chair also includes a right arm support 21 and a left arm support 22. Each arm support 21,22 includes an upper arm engaging platform 21A,22A that is oriented transversely, and preferably at approximately 90°, with respect to a lower arm engaging platform 21B,22B. The right arm support 21 supports a person's right arm, and the left arm support 22 supports a person's left arm when the person is seated in the chair 1. In this respect, the right arm support 21 is attached to the chair frame 14 by way of a flange portion 21C that extends from an upper portion of the right arm support 21 and upwardly to a pivot shaft mounted within the right arm pivot point mounting bearing 15 so that the right arm pivot point mounting bearing 15 acts as a pivot point for the movement of the right arm support 21. A lower surface or bottom of the right arm support 21 is pivotally connected to a right arm actuator 23, such as an electric motor, hydraulic cylinder(s), pneumatic cylinder(s), or the like, that drives a reciprocating driving mechanism 23A, such as a rack and pinion mechanism for reciprocally moving a member or rod 23B.

Likewise, a left arm support 22 is attached to the chair frame 14 by way of a flange 22C that extends from an upper portion of the left arm support 22 and upwardly to a pivot shaft mounted within the left arm pivot point mounting bearing 16 so that the left arm pivot point mounting bearing 16 acts as a pivot point for the movement of the left arm support 22. A lower surface or bottom of the left arm support 22 is pivotally connected to the left arm actuator 24, such as an electric motor, hydraulic cylinder(s), pneumatic cylinder(s), or the like, that drives a reciprocating driving mechanism 24A, such as a rack and pinion mechanism for reciprocally moving a member or rod 24B.

As such, the chair frame 14 supports the chair back 12, the chair seat 13, upper bearing brackets (not shown) for both the right arm support 21 and the left arm support 22, two upper base brackets (not shown) which contain the right arm actuator 23 and the left arm actuator 24 for the driving mechanisms 23A, 24A, lower bearing brackets (not shown) for both the right leg support 19 and the left leg support 20, two lower base brackets (not shown) which contain the right leg actuator 25 and the left leg actuator 26 for the driving mechanisms 25A, 26A, and the electro-mechanical power system 6 which powers the movements of the cross-crawl chair 1.

To exemplify an "arm and opposing leg" movement, the Figures illustrate the right arm support 21 being driven in conjunction with the left leg support 20. However, in addition to providing a cross-crawl motion, the chair 1 can also provide homolateral movement, such as the right arm support 21 being moved with the right leg support 19. Further, the right arm support 21, the left arm support 22, the right leg support 19, and the left leg support 20 are all independently moveable of each other.

The cross-crawl chair 1 also includes electrical connections 30 that connect the right arm actuator 23, the left arm actuator 24, the right leg actuator 25, and the left leg actuator 26 with the electrical enclosure 6, which powers and provides the timing function for the chair 1 when the chair 1 is providing "arm and opposing leg" movement. The electrical connections 30 provide the driving power, as well as the opposite arm/opposite leg timing to the right arm support 21, to the left arm support 22, to the right leg support 19, and to the left leg support 20 via means of the right arm actuator 23, the left arm actuator 24, the right leg actuator 25, and the left leg actuator 26 respectively.

In the preferred embodiment, when the chair 1 is in operation to provide a cross-crawl motion, the electrical enclosure 6 will send simultaneous signals to the mechanical/hydraulic drive mechanisms of the right arm actuator 23 and the left leg actuator 26 to mechanically/hydraulically move the right arm support 21 and the left leg support 20 upwardly, respectively, while sending simultaneous signals to the mechanical/hydraulic drive mechanisms of the left arm actuator 24 and the right leg actuator 25 to mechanically, hydraulically, and/or pneumatically move the left arm support 22 and the right leg support 19 downwardly, respectively.

Further, controls in the electrical enclosure 6 will allow an operator to vary the speed, range, and duration of the cross-crawl movement. Specifically, the controls allow a user to adjust the speed of the cross-crawl movement from quite slow to fast, to vary the range from a little movement to a larger movement, and to control the duration of the cross-crawl motion from a short time treatment cycle to a longer one. Further, the controls are adjustable so the cross-crawl chair 1 can be used to treat people of all sizes and can be adjusted to fit every kind of treatment level.

The controls also can be set to disable the movement of the right arm support 21, the left arm support 22, the right leg support 19, or the left leg support 20, in any combination necessary to treat a particular individual. The disabling mechanism can be programed to restrict movement to any possible combination of the arm and the leg supports, as necessary, to treat any person, such as a person who has lost a limb, or a person who has a spinal cord, neck or head injury, or a hip or shoulder injury, in order to fit that person's physical and neurological shortcomings.

Further, the cross-crawl chair 1 is scalable to fit a wide range of human sizes. Specifically, the chair seat 13 and the chair back 12 can be adjusted within the chair frame 14 to accommodate people of varying heights, widths, and weights.

In view of the foregoing description of the preferred embodiment, the cross-crawl chair is able to provide a user afflicted with partial or complete paralysis or other types of injury or illness that causes the user to loose partial or full use of his or her limbs with therapeutic "arm and opposing leg" motion treatment. In contrast to exercise machines, which strengthen muscles, the cross-crawl chair is designed as a neurological retraining device to re-pattern a user's brain and spinal cord via an "arm and opposing leg" motion to generate and organize correct signals to allow voluntary control of the user's limbs, head and neck, and extremities. Thus, in further contrast to conventional exercise machines, the cross-crawl chair does not require any physical input from the user to provide the cross-crawl motion, but rather utilizes four independently controlled drive mechanisms and an electronic control system to provide the "arm and opposing leg motion." Moreover, the arm and leg supports of the cross-crawl chair are intended to fully support the upper and lower portions of a user's arms and legs, since the cross-crawl chair is designed for users who lack full control of their limbs. In sum, the cross-crawl chair is very different from conventional exercise machines.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. For example, the prototype plans already include a small chair for children, and a larger chair to accommodate heavy adults, in addition to our standard sized chair for adults. Having thus described the invention, what is desired to be protected by Letters Patent is presented in the subsequently appended claims.

I claim:

1. A cross-crawl chair comprising:

a chair frame;

a chair back mounted to the chair frame;

a chair seat mounted from the chair frame so as to extend transversely relative to the chair back;

a right arm actuator mounted relative to the chair frame and driven by a first drive mechanism;

a left arm actuator mounted relative to the chair frame and driven by a second drive mechanism;

a right leg actuator mounted relative to the chair frame and driven by a third drive mechanism;

a left leg actuator mounted relative to the chair frame and driven by a fourth drive mechanism;

a right arm support having an upper end pivotally suspended from the chair frame at a first point adjacent to and spaced adjacent an upper portion of the chair back so that the right arm support is pivotally movable in an arc about the first pivot point and a lower portion attached to the right arm actuator;

a left arm support having an upper end pivotally suspended from the chair frame at a second point adjacent to and spaced adjacent an upper portion of the chair back so that the left arm support is pivotally movable in an arc about the second pivot point and a lower portion attached to the left arm actuator;

a right leg support having an upper end pivotally suspended from the chair frame at a third point spaced above and outwardly of the seat so that the right leg support is pivotally movable in an arc about the third pivot point and a lower portion attached to the left leg actuator;

a left leg support having an upper end pivotally suspended from the chair frame at a fourth pivot point spaced above and outwardly of the seat so that the left leg support is pivotally movable in an arc about the fourth pivot point and a lower portion attached to the left leg actuator;

a control system mounted to the chair frame that controls the first, second, third, and fourth drive mechanisms so that the right arm support, left arm support, right leg support and left leg support are driven independently, and wherein the control system includes control means for synchronizing movement of the right arm actuator with the left leg actuator and the movement of the left arm actuator with the right leg actuator by controlling said first, second, third and fourth drive mechanisms so as to provide a cross-crawl motion.

2. The cross-crawl chair of claim 1, wherein said control means includes means for controlling a speed of the cross-crawl motion, a length of time of the cross-crawl motion, and a range of movement of the cross-crawl motion.

3. The cross-crawl chair of claim 1, wherein the right arm support is attached to the chair frame via a right arm support mounting bearing that serves as the first pivot point for the right arm support and wherein the left arm support is attached to the chair frame via a left arm support mounting bearing that serves as the second pivot point for the left arm support.

4. The cross-crawl chair of claim 3 wherein the right leg support is attached to the chair frame via a right leg support mounting bearing that serves as the third pivot point for the right leg support and wherein the left leg support is attached to the chair frame via a left leg support mounting bearing that serves as the fourth pivot point for the left leg support.

5. The cross-crawl chair of claim 4, wherein each of the right and left arm and the right and left leg actuators includes a reciprocating element for pivoting related left and right arm supports and left and right leg supports about the first, second, third and fourth pivot points.

6. The cross-crawl chair of claim 1, including a headrest that is moveably mounted to the chair back so that the cross-crawl chair is adjustable to accommodate users of different sizes.

7. The cross-crawl chair of claim 1, wherein each of the first, second, third and fourth actuators includes reciprocating elements for pivoting related left and right arm supports and left and right leg supports about the first, second, third and fourth pivot points.

8. The cross-crawl chair of claim 1, wherein each of the right and left arm supports includes an upper arm engaging portion and a lower arm engaging portion that are non-movable relative to one another and oriented transversely relative to one another.

9. The cross-crawl chair of claim 8, wherein each of the right and left leg supports includes an upper leg engaging portion and a lower leg engaging portion that are non-movable relative to one another and oriented transversely relative to one another.

10. The cross-crawl chair of claim 9, including a footrest extending transversely relative to each of the lower leg engaging portions of the right and left leg supports.

11. The cross-crawl chair of claim 9, wherein each upper arm engaging portion and lower arm engaging portion of the right and left arm supports are fixed relative to one another at approximately 90°, and each upper leg engaging portion and lower leg engaging portion of each of the right and left leg supports are fixed relative to one another at approximately 90°.

12. The cross-crawl chair of claim 11, including a footrest extending transversely relative to each of the lower leg engaging portions of the right and left leg supports.

13. The cross-crawl chair of claim 1, wherein each of the right and left arm actuators and the right and left leg actuators are mounted so as to extend upwardly and forward relative to the back and seat of the chair, respectively.

14. The cross-crawl chair of claim 5 wherein each of the right and left arm supports includes a flange portion for pivotally connecting the right and left arm supports to the right and left arm support mounting bearings for movement independent of the seat.

15. The cross-crawl chair of claim 14 wherein each of the right and left leg supports include connector means that extend on opposite sides of the seat and upwardly of the seat relative to one another to the right and left leg support mounting bearings.

* * * * *